United States Patent [19]

Theisen

[11] Patent Number: 4,817,831

[45] Date of Patent: Apr. 4, 1989

[54] DISPENSING CAP WITH EXPANDABLE PLUG

[76] Inventor: G. Jerry Theisen, 4950 Mountain Lakes Blvd., Redding, Calif. 96003

[21] Appl. No.: 173,868

[22] Filed: Mar. 28, 1988

[51] Int. Cl.[4] ..... B67D 5/32

[52] U.S. Cl. ..... 222/499; 222/525; 222/542; 222/546; 222/563

[58] Field of Search ..... 222/521, 525, 546, 498, 222/499, 512, 513, 514, 519, 520, 522, 523, 524, 547, 559, 563, 542; 220/240; 215/271

[56] References Cited

U.S. PATENT DOCUMENTS

| | | | |
|---|---|---|---|
| 2,060,622 | 11/1936 | Jones | 222/521 |
| 3,010,619 | 11/1961 | Gronemeyer et al. | 222/521 |
| 3,194,453 | 7/1965 | Cherba | 222/521 |
| 4,261,487 | 4/1981 | Seager | 222/520 |
| 4,314,656 | 2/1982 | Kessler | 222/525 X |
| 4,690,304 | 9/1987 | Morel | 222/521 X |

FOREIGN PATENT DOCUMENTS

| | | | |
|---|---|---|---|
| 995521 | 6/1965 | United Kingdom | 222/521 |

*Primary Examiner*—Joseph J. Rolla
*Assistant Examiner*—Nils E. Pedersen

[57] ABSTRACT

An expandable sealing plug and supporting structure adaptable for both pull-to-open, push-to-close and twist-to-open, twist-to-close captive dispensing caps is provided. The expandable plug is manufactured with thinner walls than that of the supporting structure and a compatible outer cap, and is designed to balloon outwardly when the assembled cap and container experience an increase in internal pressure. This ballooning affect tightens the connection between the plug and the dispensing orifice in the outer cap, thereby increasing the sealing of the dispensing cap. Material resilience returns the plug to the original plug shape on release of internal pressure and maintains original plug shape when no unusual pressure is applied.

3 Claims, 2 Drawing Sheets

DISPENSING CAP WITH EXPANDABLE PLUG

BACKGROUND OF THE INVENTION

1. Field of the Invention

This invention relates to two piece captive dispensing caps which utilize central plugs or posts as the major sealing means. The present invention is particularly directed towards a sealing plug manufactured with a hollow interior which is designed to balloon outwardly under internal pressure. This ballooning increases the tightness of the seal between the plug of the inner cap and the dispensing aperture of the outer cap in use. When the plug structure assembled in an outer cap on a container comes under internal pressure, the plug swells thereby increasing the effectiveness of the seal.

2. Description of the Prior Art

The use of removable caps to retain the contents of containers has been in use for many years, and many of those caps were lost or misplaced, thereby creating the need for a captive or retained cap. Many styles of retained caps have since been manufactured and the most common styles are the flip top, the twist open and close cap and the push/pull cap. Many of these caps utilize a central core or plug as the means of sealing the aperture through which the contents of the container are dispensed. As my new design in plugs can be utilized on many styles of caps, the following search is primarily directed towards captive dispensing caps having a central sealing plug, and particularly those with a hollow inner core.

The search conducted produced the following Patents:

1. A patent was issued to Gronemeyer et al, on Nov. 28, 1961, U.S. Pat. No. 3,010,619, which illustrates a hollow core plug designed to expand when the top twist open/close cap is applied and seated in the closed position.

2. U.S. Pat. No. 3,578,223, dated May 11, 1971, was issued to Armour for a partially hollow center post having a non-functional purpose on a twist-to-open cap.

3. On Aug. 21, 1956, Dahlin was issued U.S. Pat. No. 2,759,643, for "Container Closure" which contains a central hollow nozzle having dispensing apertures.

4. A patent issued to Roggenburg, Jr., on Oct. 2, 1984, U.S. Pat. No. 4,474,314, illustrates a self-closing squeeze bottle having a central vented valve.

5. The Stull patent issued on Oct. 16, 1984, U.S. Pat. No. 4,477,002, shows a two piece cap with a central solid core plug.

One major problem involving the captive dispensing cap has been the leakage of the container contents when the assembled unit comes under pressure. This leakage generally occurs between the dispensing orifice and the central sealing plug, which are not designed to accommodate an increase in internal pressure. This problem is especially obvious when the assembled filled containers are shipped by air in unpressurized cargo holds or experience an increase in temperature during transportation, both resulting in a build up of internal pressure and subsequent leakage. Some past art devices utilize pressure releasing vents, which unfortunately often release the container contents as well when the pressure increases beyond an optimum point.

The hollow central stem of Gronemeyer's patent, U.S. Pat. No. 3,010,619, is designed to expand in a different method and for a different purpose from the sealing plug of my invention. The angle of the top distal surface of the central stem of the Gronemeyer device is designed to connectively interact with the angled surface of the dispensing opening only when the side walls of the central stem are bowed. This bowing action of the walls is a functional design feature of the cap, being accomplished through the tightening action of the outer cap onto the inner cap. The central stem is in essence, too tall for the device and must be depressed and bowed to achieve a correct connection. In other words, the correct sealing apex angle of the central stem with the dispensing opening necessitates the bowing of the outer walls of the central stem or the seal would not be sufficient. Gronemeyer makes no claim as to the plug having the ability to expand when under increased internal pressure and even if expansion is possible the excess bowing of the side walls of the central stem, beyond that which it is designed, causes an adjustment in the apex angle of the stem and dispensing opening thereby creating an ineffective seal. Although the bowing action of the central stem is effective for normal sealing of the dispensing opening, it does not compensate or overcome the effect of increased internal pressure, and Gronemeyer makes no claim to the contrary.

The central stem of U.S. Pat. No. 3,578,223, although hollow, has thickened side walls not suitable or functionable to be inflated.

The Dahlin patent, U.S. Pat. No. 2,759,643, illustrates a central core having at least one dispensing aperture through the side wall, which prevents the core from expanding under pressure.

The Roggenburg, Jr. patent, U.S. Pat. No. 4,474,314, shows a central hollow core also having apertures through the side walls which again prevents expansion.

U.S. Pat. No. 4,477,002, provides an example of solid core central plugs, which effectively seal the dispensing aperture but fail to expand and effect an increase in sealing means when under pressure.

I feel my invention of the ballooning central plug overcomes the previously mentioned disadvantages of the earlier past art patents and therefore provides new and useful benefits and improvements applicable to the design of both push/pull and twist open/close captive cap closures.

SUMMARY OF THE INVENTION

In practicing my invention I have provided a novel improved central stopper plug designed to increase the sealing means of dispensing caps assembled onto filled containers, when subjected to an increase in internal pressure.

To accomplish increased sealing, my plug is manufactured as an inner cap, thin walled, of pliable plastic, and fits the dispensing aperture in a covering outer cap. The plug is tubular and has a rim around the upper edge sized to somewhat overlap the aperture of the outer dispensing cap. The plug is affixed stationary but is mobile in the aperture to open and close the dispensing aperture when the covering outer cap is moved upwardly and downwardly with the caps attached to the neck of a container. The top surface of my plug is somewhat concaved and in the closed position, the rim rounding the upper edge rests on the outer cap surface covering the lip of the aperture. If internal pressure occurs in the container, the tip of the plug balloons causing the concaved top surface to swell upwardly, the walls to become tighter upwardly in the dispensing aperture, and the under surface of the edge rim to press downwardly on the upper surface of the cap sealing the aperture. The pliability of the plug material is sufficient to allow the plug rim to snap through the outer cap aperture.

The method used in manufacturing the outer dispensing cap and the inner cap with ballooning plug of my invention is well known to plastic fabricators. A mold is machined to the specification of the outer cap and to the inner cap with plug structure and both are injection molded using a strong thermal moldable plastic such as polyethylene. The plug is affixed like a stem supported centrally by brackets in an opened vertically aligned tube. The plug rim end of the plug protrudes above the upper edge of the tube. A passageway is open between the plug and the tube wall. The tube is affixed downwardly with a cap sized and threaded to fit the neck of a container. Containers used with my cap are squeeze type fabricated of pliable plastic. The tube is opened through the cap so the flowable contents in the container on which the cap is used is directed upwardly through the tube when the container is pressed. The outer cap is unthreaded and arranged to snap upwardly and downwardly on the vertically aligned tube supporting my plug to open and close the aperture in the top of the cap.

Therefore, it is a primary object of my invention to provide a central stopper plug for two-piece captive dispensing caps which is designed to balloon outward under increase pressure and tighten the seal between the stopper plug of the inner cap and the dispensing aperture of the outer cap.

Another object of my invention is to provide an expandable stopper plug which can be adapted for both twist open/close caps and push-to-close and pull-to-open caps.

A further object of my invention is to provide an expandable stopper plug which is economical to manufacture and easy and reliable to operate with a variety of dispensing materials, such as liquids, semi-viscous substances, and powders.

Other objects and the many advantages of the present invention will become better understood by reading the specification and comparing numbered parts therein with similar numbered parts in the included drawings.

DRAWING REFERENCE NUMBERS

Figure 1:
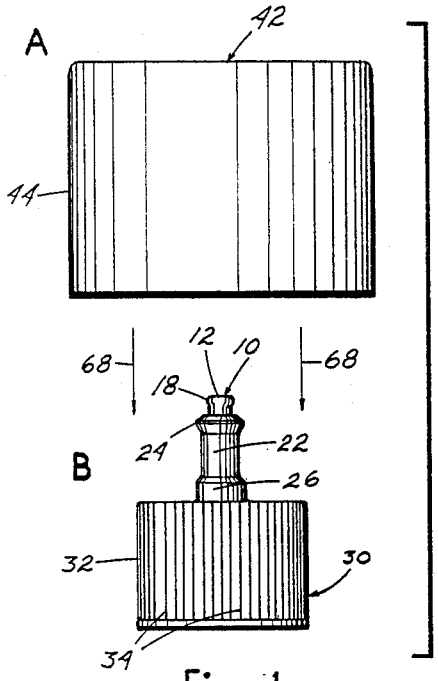
FIG. 1A is a side view of the outer cap and B is a side view of the inner cap with the expandable plug.

10 plug
12 plug top
14 plug side wall
16 opened plug bottom
18 plug rim
20 plug support brackets
22 annular plug support member
24 double beveled flange collar
26 sealer sleeve guide
28 flow apertures
30 inner cap
32 inner cap exterior wall
34 exterior wall guide striations
36 internal threads
38 inner cap washer ring
40 mold extraction notches
42 outer cap
44 outer cap exterior wall
46 dispensing aperture
48 beveled aperture edge
50 inner cap sleeve
52 internal sealer sleeve
54 outer-wall support brackets
56 inner-wall support brackets
58 vertical cap guides
60 sealer ring
62 threaded neck
64 container
66 container contents
68 directional arrows
70 flow path
72 pressure indicating arrows

DESCRIPTION OF THE PREFERRED EMBODIMENT

Figure 2:
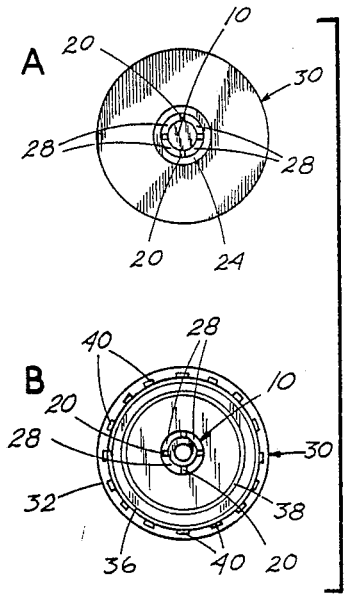
FIG. 2A is a top view of the inner cap, and B is a bottom view of the same cap.
Figure 3:
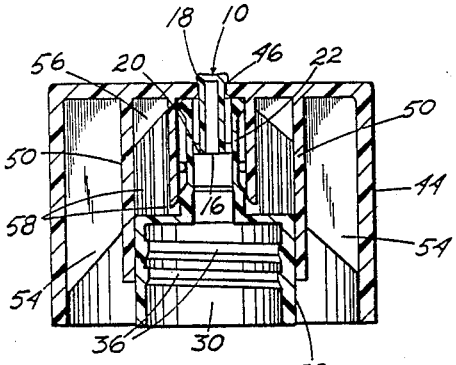
FIG. 3 is a side view of the assembled outer and inner cap with the expandable plug in the closed position not under pressure.
Figure 6:
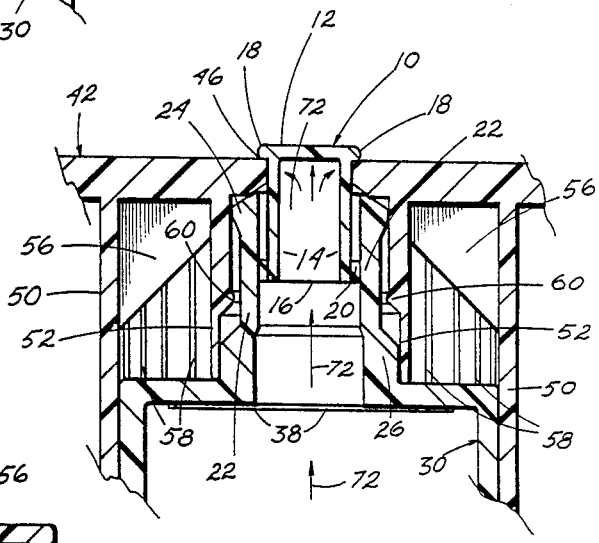
FIG. 6 is an enlargement of the assembled outer and inner cap, showing the expandable plug while under increased internal pressure, illustrating the expanded state of the top surface and sides walls.
Figure 7:
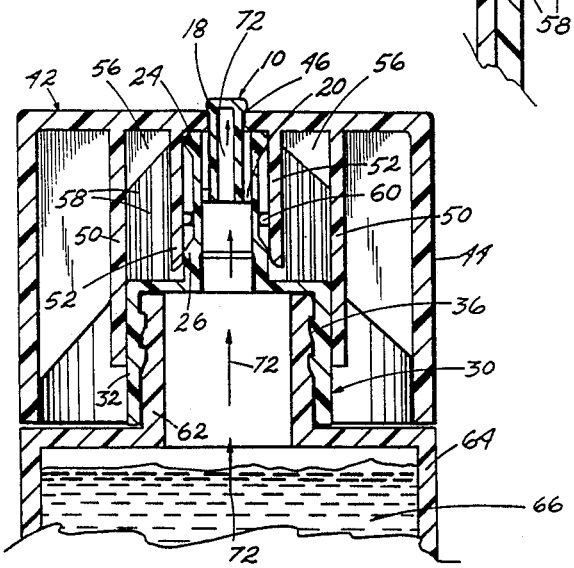
FIG. 7 is a side view of the assembled cap again illustrating the effect of internal pressure on the expandable plug.

Referring now to the drawings where the preferred embodiment is attached to a push-to-close, pull-to-open style dispensing cap manufactured of plastic. The preferred embodiment of plug 10, shown assembled in FIG. 1 B, is structured of a vertically oriented hollow tube having a slightly concave closed plug top 12, plug side wall 14, and opened plug bottom 16. Plug 10 has slightly projecting rounded plug rim 18 formed onto the edge of plug top 12. Attached to the bottom edge of plug side wall 14 are four horizontal rectangular plug support brackets 20, seen in FIG. 2. These four plug support brackets 20 and are attached edgewise to the interior of annular plug support member 22. Annular plug support member 22 is also a vertically oriented cylindrical hollow tube with an opened top end supporting double beveled flange collar 24, best seen in FIG. 5, 6, and 7. Double beveled flange collar 24, shown in profile in FIG. 1 B, has a downwardly projecting top bevel which terminates in a short vertical wall. From this vertical wall there is an inwardly projecting bevel which terminates back into the wall of annular plug support member 22. The purpose of double beveled flange collar 24 will be fully explained later on. The outer wall of annular plug support member 22 again bevels outward on the bottom section, forming sealer sleeve guide 26. Sealer sleeve guide 26 serves to guide and support another annular wall which will be defined in detail later. Space is created between plug side wall 14 and the interior wall of annular plug support member 22 due to the existence of plug support brackets 20. This space forms flow apertures 28. Annular plug support member 22 is attached on the bottom edge to the top surface of inner cap 30, shown in FIG. 1 B. Inner cap 30 is a short cylindrical shaft having a closed top section with a central orifice around which is attached annular plug support member 22. Inner cap 30 has one inner cap exterior wall 32 which contains on the outside, exterior wall guide striations 34, and on the interior, internal threads 36. Inner cap 30 has inner cap washer ring 38 molded inherently to the inner surface of the top section which will be explained later in the specification, along with other features of inner cap 30. The bottom edge of inner cap exterior wall 32 has a multiple of mold extraction notches 40 designed expressly for the purpose of easy removal of inner cap 30 from the mold in which it was formed.

Inner cap 30, with plug 10, works in conjunction with outer cap 42, an example of available outer caps useful with the present invention. Outer cap 42, shown in FIG. 1 A, and 3 through 7, is a short cylindrical tube having an opened bottom surface, a closed top surface and three concentric annular walls. The closed top surface of outer cap 42 contains dispensing aperture 46 which in turn contains, on the bottom edge, beveled aperture edge 48. Outer cap exterior wall 44 forms the outermost wall, while inner cap sleeve 50 forms the middle wall, with internal sealer sleeve 52 forming the third innermost wall. Several angled support brackets are formed between the concentric walls for strength and rigidity. The support brackets between outer cap exterior wall 44 and the outer wall of inner cap sleeve 50 are called outer wall support brackets 54, and the brackets between the inner wall of inner cap sleeve 50 and internal sealer sleeve 52 are called inner wall support brackets 56. The interior of inner cap sleeve 50 is affixed with a multiple of vertical cap guides 58, best seen in FIG. 5, 6 and 7. Inner cap sleeve 50 is sized to be inserted over inner cap exterior wall 32, guided by vertical cap guides 58 and exterior wall guide striations 34 located on inner cap exterior wall 32, for the purpose of limiting rotational movement of the two caps. Internal sealer sleeve 52 has inherently molded into the interior, sealer ring 60. Sealer ring 60 is a horizontal annular ring positioned midway in the interior of internal sealer sleeve 52 and forms part of the sealing means of the assembled cap.

Figure 4:
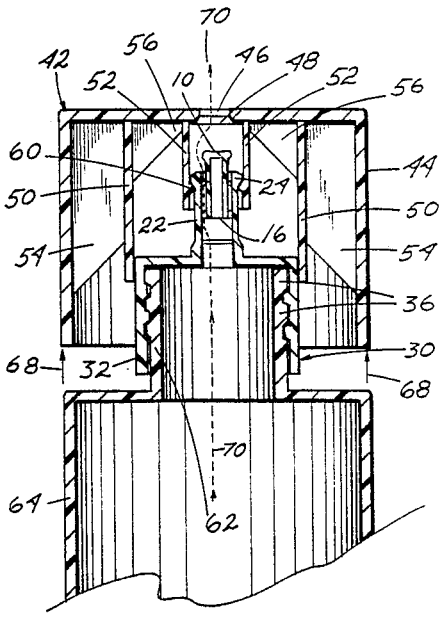
FIG. 4 is a side view of the assembled outer and inner cap in the open position, with the expandable plug not under pressure.

In assembly, outer cap 42 is positioned over inner cap 30, aligning dispensing aperture 46 over plug 10. When outer cap 42 is pressed down, see FIG. 1, directional arrows 68, over inner cap 30, inner cap sleeve 50 is inserted over inner cap exterior wall 32. Internal sealer sleeve 52 is inserted over annular plug support member 22, initially forcing sealer ring 60 over the outer edges of double beveled flange collar 24. The shape of double beveled flange collar 24 is significant in that the apex angle of the top of double beveled flange collar 24 correlates with the angle of beveled aperture edge 48 located on dispensing aperture 46. The short vertical angle between the double beveled angles of double beveled flange collar 24 tightly adjoin the inner wall of internal sealer sleeve 52, helping to form a leak-proof seal. The bottom downward angled bevel of double beveled flange collar 24 is less significant, but does help to ease removal of the outer cap 42 from inner cap 30. A more secure connection of the two caps is made when the lower bevel is manufactured in a right angle to inhibit the removal of sealer ring 60 from over double beveled flange collar 24. Sealer ring 60 is movably captive between double beveled flange collar 24 on the top and sealer sleeve guide 26 on the bottom. Sealer sleeve guide 26 also serves as a support and guide for the lower section of internal sealer sleeve 52. Plug rim 18 is sized slightly larger than dispensing aperture 46 and passes through dispensing aperture 46 with a slight effort, forming a snap-type connection. The assembled cap as a whole is manufactured of plastic material with plug 10 having thinner walls than that of the rest of the cap structure. Since the plastic material has flexible and elastic qualities, plug rim 18 can be slightly compressed in order to be forced through dispensing aperture 46. The assembled dispensing cap is in the closed position when outer cap 42 is pressed down and seated over inner cap 30 with plug top 12 slightly projecting past dispensing aperture 46. The assembled cap can be removably attached to the threaded neck 62 of filled container 64 by internal threads 36 of inner cap 30. When dispensing container contents 66, outer cap 42 is pulled up vertically and plug 10 is recessed down from dispensing aperture 46. Container contents 66 can now be removed , as seen in FIG. 4, the dotted outline indicating flow path 70, through the interior of threaded neck 62 of container 64, through the inner section of annular plug support member 22, around plug support brackets 20 through flow apertures 28, up between outer plug side walls 14 and annular plug support member 22, out over plug top 12 to finally be expelled out dispensing aperture 46. A small amount of container contents 66 will accumulate within plug 10 during dispensing, but with the natural flow of gravity, will flow back down into container 64.

Figure 5:
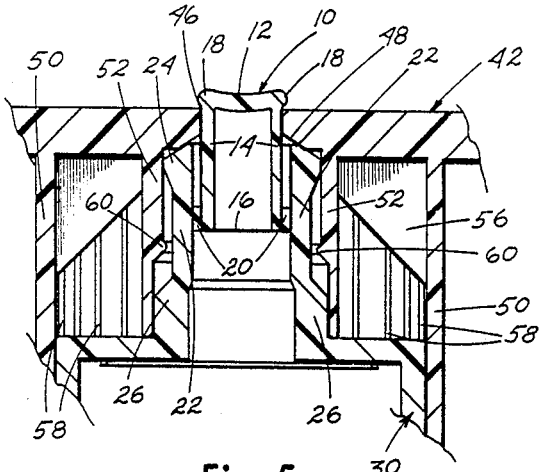
FIG. 5 is an enlargement of the assembled outer and inner cap, showing the appearance of the expandable plug when in the closed but unpressurized position.

FIG. 5 illustrates plug 10 with plug top 12 in the normal concave configuration. When the assembled dispensing cap is attached to filled container 64 and subject to increased internal pressure, as in FIG. 6, the thinner plug side wall 14, in the area passed through dispensing aperture 46, balloon and expand outward while plug top 12 expands into a flattened position. Since plug 10 is manufactured with thinner walls than that of the rest of the dispensing cap, less internal pressure is needed to effect this ballooning action on plug 10 than any section of the assembled cap or container 64. By this action, plug 10 increases the seal against dispensing aperture 46 on the surface by deflecting the apex angle of plug rim 18 when the concave angle of plug top 12 is forced outward, conforming that angle to match that of the inner top edge of dispensing aperture 46, best seen in FIG. 6 with pressure indicating arrows 72 indicating the directional force of the internal pressure applied at the section in the aperture on plug side wall 14 and to plug top 12. The sealing effect is increased against the wall of dispensing aperture 46 by the outward ballooning of the aperture inserted section of plug side walls 14. Therefore, as the pressure increases, up to a maximum point, so does the sealing effect.

In the manufacturing process, both outer cap 42 and plug 10 with support structure and inner cap 30 are fabricated of plastic. A mold is machined to the specification of the outer cap and to the inner cap and plug structure and the caps are injection molded using a strong thermal moldable plastic such as polyethylene. The plug side wall 14 and concaved plug top 12 of plug 10 are thin lined for pliability. Threads on the inside wall of inner cap 30 fit the threaded neck 62 of container 64 and hold the attached plug side wall 14 and plug 10 vertically aligned on top of container 64. Outer cap 42 fits over inner cap 30 and can slide up and down thereon guided by striations 34 on inner cap exterior wall 32 in vertical cap guides 58 which are matching striations on the inside wall of outer cap 42. Internal sealer sleeve 52 of outer cap 42 slides up and down on plug side wall 14 and plug 10 is sealably inserted into dispensing aperture 46 when outer cap 42 is pushed downwardly. When outer cap 42 is pulled upwardly plug 10 snaps out of dispensing aperture 46 downwardly opening a fluid flow path. Plug 10 is pliable and thin walled and is rimmed upwardly by plug rim 18. Plug rim 18 snaps through dispensing aperture 46 when outer cap is pushed fully downwards. If undesirable internal pressure is applied to container 64, plug top 12 tends to balloon upwardly tightening plug rim 18 in the top of dispensing aperture 46.

While my invention has been described in detail in the specification and depicted in detail in the accompanying drawings, it is not to be limited to those specific aspects, whereas modifications in design could be practiced without departing from the intended scope of the appended claims.

What is claimed is:

1. An expandable plug with supporting structure for a captive dispensing cap, comprising:

a. a substantially cylindrical hollow plug having a concave closed end with an encircling overhanging rim and a circumferal outer wall terminating oppositely said closed end at an opened end; the orientation of said hollow plug being said outer wall vertically inclined, said closed end the top thereof and said opened end the bottom thereof; said hollow plug being thin-walled and sufficiently pliable to expand outwardly from pressure applied internally and by resilience in the material to return to an original shape and to an original position in a containing cap;

b. an elongated cylindrical support wall for said plug; said support wall lengthwise vertically inclined having an opened top end flanged outwardly with said flange having a beveled top and a beveled bottom and collaring said support wall top end therearound, said support wall enlarged downwardly into a widened sleeve end with said widened sleeve having a beveled top, there being a narrowed expanse between said collaring flange and said widened sleeve sized for slide-fitting the structure of a top-apertured snap-to-open, snap-to-close external cap; internally said support wall having spaced plug-support brackets attached to the sides of said plug with said plug protruding somewhat above the opened top end of said plug support wall, there being a multiple of passageways opening between said spaced brackets alongside of said plug;

c. a container compatible inner cap with vertically striated outer side wall surfaces in accord with similar inner surfaces on said apertured external outer cap, said container compatible inner cap threaded internally to the size of threads on a container neck and affixed to said downwardly widened sleeve end of said support wall as a larger continuation thereof, said inner cap having a flattened top with an aperture therein to provide an opened passageway from said container through said openings between said spaced brackets alongside of said plug.

2. The expandable plug of claim 1 wherein said expandable plug and said supporting structure is manufactured of plastic materials.

3. The expandable plug of claim 1 wherein said expandable plug and said supporting structure fits covered in said top-apertured external cap, said external cap is a plastic, captive dispensing cap, and said expandable plug and said supporting structure is operational in said dispensing cap to open and close said apertured top by push to close and pull to open movements of said dispensing cap.

* * * * *